US008544434B2

(12) United States Patent
Lin et al.

(10) Patent No.: US 8,544,434 B2
(45) Date of Patent: Oct. 1, 2013

(54) LOCK PIN FOR VARIABLE VALVE TIMING MECHANISM

(75) Inventors: Yeongching Lin, Ann Arbor, MI (US); Neal Berner, Ypsilanti, MI (US); Kyle Bernier, Clarkston, MI (US); Toshiharu Noguchi, Toyota (JP)

(73) Assignees: Toyota Motor Engineering & Manufacturing North America, Inc., Erlanger, KY (US); Toyota Motor Corporation, Toyota (JP)

( * ) Notice: Subject to any disclaimer, the term of this patent is extended or adjusted under 35 U.S.C. 154(b) by 51 days.

(21) Appl. No.: 13/303,363

(22) Filed: Nov. 23, 2011

(65) Prior Publication Data

US 2013/0125845 A1 May 23, 2013

(51) Int. Cl.
*F01L 1/34* (2006.01)

(52) U.S. Cl.
USPC ..... 123/90.17

(58) Field of Classification Search
USPC ..... 123/90.15, 90.17; 464/160, 161; 74/567, 568 R
See application file for complete search history.

(56) References Cited

U.S. PATENT DOCUMENTS

| | | | | |
|---|---|---|---|---|
| 5,689,999 | A | 11/1997 | Wiley et al. | |
| 6,199,524 | B1 * | 3/2001 | Ushida | 123/90.17 |
| 6,935,291 | B2 * | 8/2005 | Kusano et al. | 123/90.17 |
| 7,004,128 | B2 * | 2/2006 | Majima et al. | 123/90.17 |
| 7,100,555 | B2 * | 9/2006 | Imaizumi et al. | 123/90.17 |
| 8,011,337 | B2 * | 9/2011 | Hayashi | 123/90.17 |
| 2004/0079309 | A1 | 4/2004 | Kinugawa | |
| 2010/0023242 | A1 | 1/2010 | Kawamura | |
| 2010/0089349 | A1 | 4/2010 | Yudate et al. | |

* cited by examiner

*Primary Examiner* — Thomas Denion
*Assistant Examiner* — Daniel Bernstein
(74) *Attorney, Agent, or Firm* — Gifford, Krass, Sprinkle, Anderson & Citkowski, P.C.

(57) ABSTRACT

The variable valve timing mechanism includes a housing, a rotor rotatably supported within the housing, and a lock pin. The housing includes a plurality of fluid chambers one of which includes a lock bore. The rotor includes a central portion and a plurality of vanes extending radially from the central portion. Each of the vanes extends into the fluid chambers of the housing to define an advanced fluid chamber and a retarded fluid chamber. One of the plurality of vanes includes a pin bore. The lock pin includes a shank section and an insertion section. The insertion section includes a nonlinear outer side profile. The lock pin is slidably received within the pin bore between an unlocked position and a locked position in which the insertion section of the lock pin is received within the lock bore of the housing thereby prohibiting relative rotation between the housing and the rotor.

12 Claims, 5 Drawing Sheets

FIG. 1A
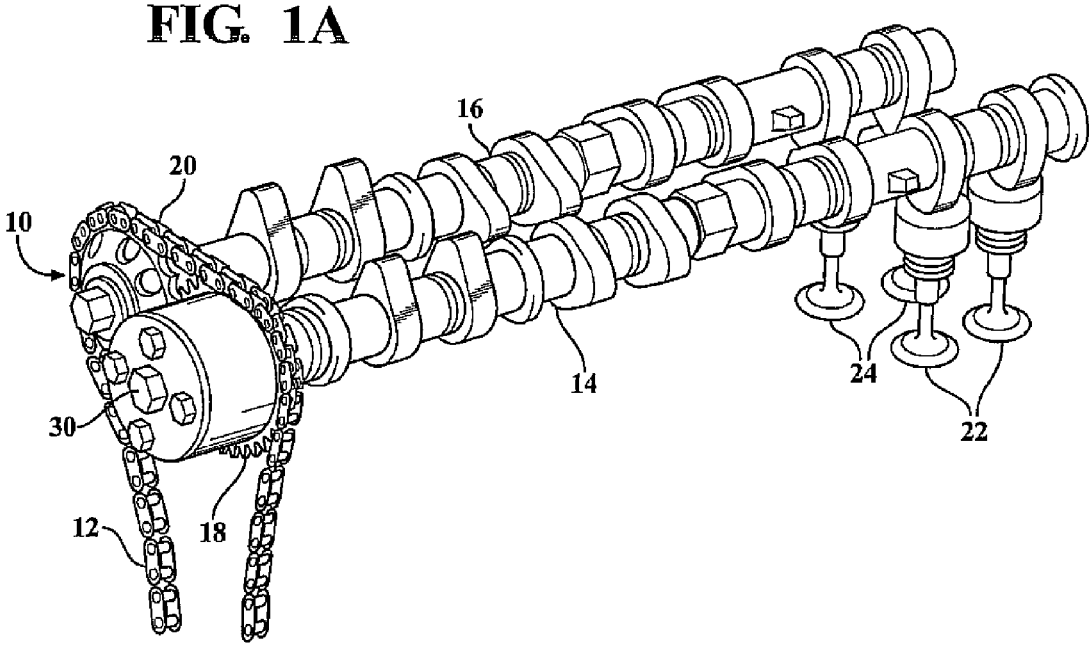
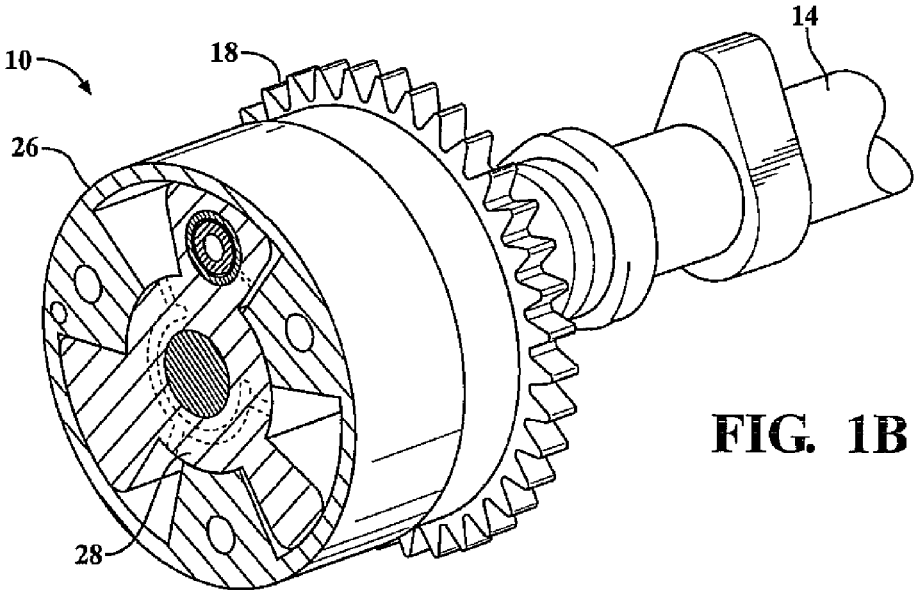
FIG. 1B

LOCK PIN FOR VARIABLE VALVE TIMING MECHANISM

FIELD OF THE INVENTION

The present invention is directed to a variable valve timing mechanism. More particularly, a variable valve timing mechanism having a lock pin that includes an insertion section having a segmented spherical shape.

BACKGROUND OF THE INVENTION

Most modern automotive vehicles include a variable valve timing mechanism in order to vary the opening and closing valve times of the exhaust and intake valves. Typically variable valve timing mechanisms include a lock pin that locks the variable valve timing mechanism during a shutdown of the internal combustion engine in preparation for the engine's next start. However, if the lock pin fails to properly engaged or disengage, the variable valve timing mechanism produces increased noise and vibrations during shutdown and startup procedures. The increase in noise and vibrations result in a decrease in customer satisfaction and affects the perception of quality of the engine.

With reference to FIGS. 5A-5C, a previously known lock pin 100 is provided with an insertion section 110 having a generally cylindrical shape. The insertion section 110 of FIGS. 5A and 5B provides reliable disengagement from the lock bore 112 as the linear outer side profile, as best seen in FIG. 5B, of the insertion section 110 prevents tilting of the lock pin 110 with respect to the lock bore 112. However, the linear outer side profile provides unreliable engagement of the lock pin 110 within the lock bore 112. As best seen in FIG. 5C, due to the similarities in the diameters of the insertion section 110 and the lock bore 112 minor misalignments prevent the reliable engagement of the lock pin 100 and the lock bore 112. In the event of a misalignment, the distal end 114 of the insertion section 110 abuts the will abut the edge of the lock bore 112 preventing engagement and causing increased noise and vibrations.

An alternative embodiment of the lock pin is disclosed in FIGS. 6A-6C a second previously known lock pin 200 includes an insertion section 210 having a tapered cylindrical shape. The tapered cylindrical shape of the insertion section 210 provides for the reliable engagement of the lock pin 200 within the lock bore 212 due to the insertion section 210 having a distal end 214 having a diameter smaller than the diameter of the lock bore 212. However, due to the linear outer side profile of the tapered cylindrical shape of the insertion section 210 the lock pin 200 is susceptible to sticking and jamming during disengagement. In the event that the lock pin 200 is tilted during disengagement, due to the misalignment of the lock pin with the lock bore 212, the linear outer side profile of the insertion section 210 becomes jammed due to a cinching effect with the lock bore 212. The resulting jam between the insertion section 210 and the lock bore 212 resulted in increased noise and vibrations of the variable valve timing mechanism.

Thus, there exists a need in the art to provide a locking pin which locks and unlocks easily without sticking so as to avoid additional noise and vibrations during engine shutdown and startup procedures.

SUMMARY OF THE INVENTION

The present invention provides a variable valve timing mechanism having a lock pin which overcomes the abovementioned disadvantages of the previously known lock pins, thereby, providing reliable engagement and disengagement of the lock pin.

In brief, the variable valve timing mechanism includes a housing, a rotor, and a lock pin. The housing includes a plurality of fluid chambers one of which includes a lock bore. The rotor is rotatably supported within the housing. The rotor includes a central portion and a plurality of vanes extending radially from the central portion. Each of the vanes extends into the fluid chambers of the housing to define an advanced fluid chamber and a retarded fluid chamber. One of the plurality of vanes includes a pin bore. The lock pin includes a shank section and an insertion section. The insertion section is provided with a segmented spherical shape. The lock pin is slidably received within the pin bore between an unlocked position and a locked position. In the locked position a portion of the insertion section of the lock pin is received within the lock bore of the housing thereby prohibiting relative rotation between the housing and the rotor.

BRIEF DESCRIPTION OF THE DRAWINGS

A better understanding of the present invention will be had upon reference to the following detailed description when read in conjunction with the accompanying drawings wherein like reference characters refer to like parts throughout the several views and in which:

FIG. 1A is a perspective view of the variable valve timing mechanism;

FIG. 1B is a partial schematic diagram view of the variable valve timing mechanism;

DETAILED DESCRIPTION OF THE INVENTION

Figure 2A:
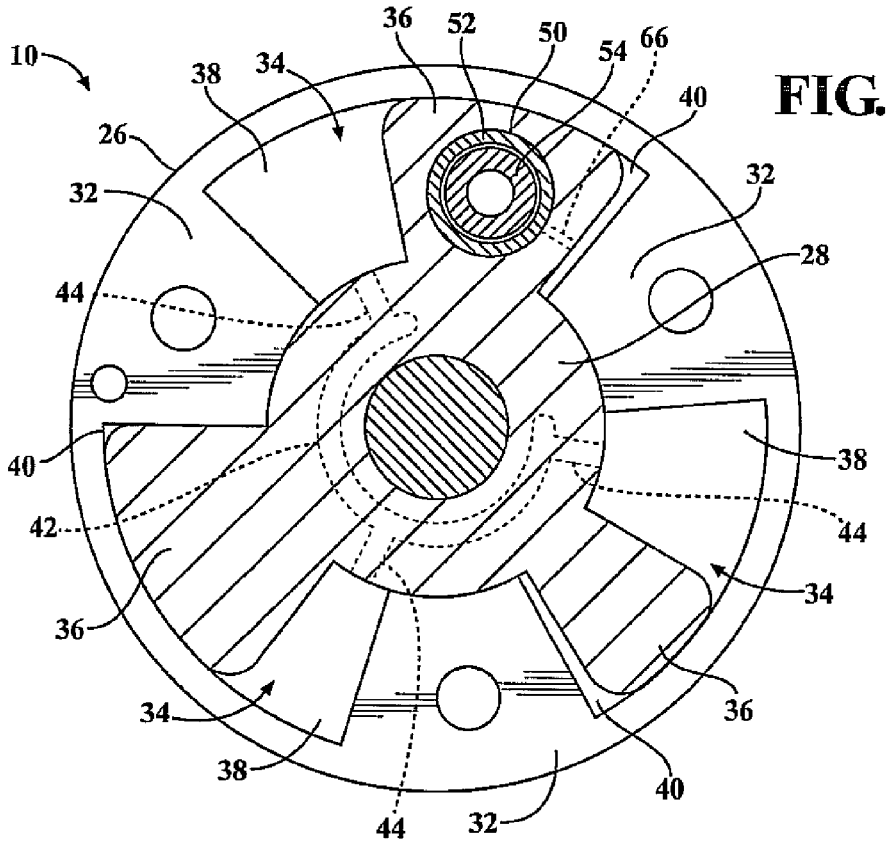
FIG. 2A is a cross-sectional view of the variable valve timing mechanism with the rotor locked in the fully advanced position.

The present invention has utility as a variable valve timing mechanism, for an internal combustion engine, that provides a lock pin that reliably engages and disengages with a lock bore to prohibit or allow relative rotation between a rotor and housing. By providing the lock pin with an insertion section having a segmented spherical shape, the lock pin can be easily inserted within a lock bore due to the smaller diameter the distal end of the insertion section with respect to the lock bore, and easily disengaged from the lock bore while avoiding a jamming effect between the lock pin and the lock bore due to the nonlinear.

With reference to FIG. 1, a variable valve timing mechanism for an internal combustion engine is generally illustrated at 10. The engine includes a crankshaft in which the reciprocating motion of pistons of the engine is converted into a rotary motion of the crankshaft. A timing chain 12 transmits the driving force from the crankshaft to an intake side camshaft 14 and an exhaust side camshaft 16 through timing gears 18 and 20, respectively. The intake side camshaft 14 is provided with the variable valve timing mechanism 10 and is configured to adjust the advance amount of the intake side camshaft 14 relative to the crankshaft. The rotation of the intake side camshaft 14 actuates intake valves 22 while the rotation of the exhaust side camshaft 16 actuates exhaust valves 24.

The variable valve timing mechanism 10 includes a housing 26 fixed to the timing gear 18 and a rotor 28 fixed to the intake side camshaft 14 via a bolt 30 extending through a central portion of the rotor 28. As the housing 26 is fixed to the timing gear 18, rotation of the crankshaft is transmitted to the timing gear 18 and the housing 26 through the timing chain 12 such that the timing gear 18 and the housing 26 are rotated synchronously with the crankshaft. The intake side camshaft 14 has one end portion fastened to the rotor 28 by the bolt 30. The rotor 28 is rotatably received within the housing 26 such that the rotor 28 is rotatable relative to the housing 26.

Figure 2B:
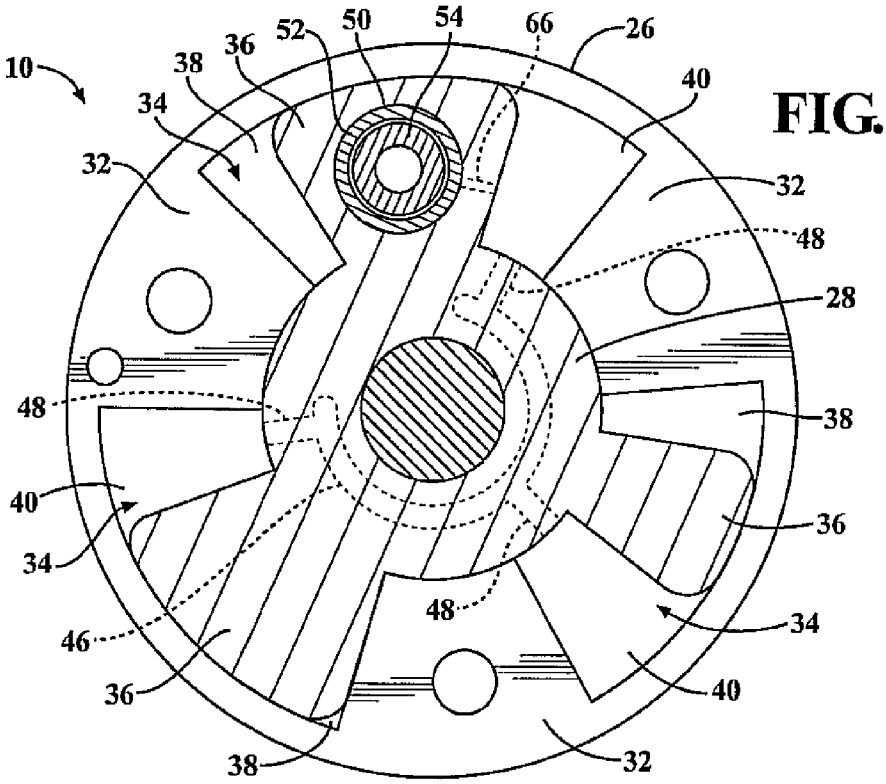
FIG. 2B is a cross-sectional view of the variable valve timing mechanism in a fully retarded position.

With reference to FIGS. 2A and 2B, the housing 26 includes protrusions 32 that extend inwardly from the outer periphery of the housing 26. The protrusions 32 defining fluid chambers 34 within the housing 26. The rotor 28 includes vanes which extend radially outward from a central portion of the rotor 28. The vanes 36 bisect each fluid chamber 34 into an advanced chamber 38 and a retarded chamber 40.

As best seen in FIG. 2A, an arcuate advanced oil passage 42 is provided in the central portion of the rotor 28. A plurality of ports 44 extend radially from the arcuate advances oil passage 42 to connect the advanced oil passage 42 to the advanced fluid chambers 38. FIG. 2B illustrates a cross section taken at a depth different than the depth of FIG. 2A. With reference to FIG. 2B, an arcuate retarded oil passage 46 is provided in the central portion of the rotor 28. A plurality of ports 48 extend radially from the arcuate retarded oil passage 46 to connect the retarded oil passage 42 to the retarded fluid chambers 40.

The variable valve timing mechanism 10 is connected to an oil pressure circuit that receives oil from an oil pan via an oil pump through a control valve. A vehicle electronic control unit (ECU) controls the oil pressure through the control valve in order to control the actual advanced amount, i.e. valve timing, of the intake side camshaft 14. The arcuate advanced passage 42 and the arcuate retarded passage 46 are in communication with channels of the control valve. In order to control the valve timing of the intake valves 22, oil from the oil pan is driven by the oil pump through the control valve to the arcuate advanced channel 42 and the arcuate retarded channel 46 to fill the advanced chambers 38 and the retarded chambers 40, respectively. The amount of oil pressure in the advanced chamber 38 and the retarded chamber 40 allows the rotor 28 to be rotated within respect to the housing 26. Accordingly, the intake side camshaft 14 is rotated due to the rotation of the crankshaft which is transmitted via the timing chain 12 and the timing gear 18 to the housing 26. The rotation of the housing 26 is transmitted to the rotor 28, specifically, the vanes 36 due to the amount of oil pressure in the advanced chambers 38 and the retarded chambers 40.

During operation of the engine the control valve varies the oil pressure in the advanced chambers 38 and the retarded chambers 40 allows the rotor 28 to be rotated relative to the housing 26. By varying the oil pressure in the advanced chamber 38 and the retarded chamber 40, the rotational phase of the intake side camshaft 14 relative to the crankshaft is variable in order to change the valve timing of the intake valves 22.

In order to lock the rotor 28 to prohibit relative rotation of the rotor 28 within the housing 26 a lock pin 54 is provided. The lock pin 54 is slidably received within a pin bore 50 formed in one of the vanes 36 of the rotor 28. A sleeve 52 is inserted into the pin bore 50 in the vane 36 in order to reduce friction between the lock pin 54 and the pin bore 50. The sleeve 52 reduces the wear caused due to the sliding movement of the lock pin 54 within the pin bore 50. As such, the sleeve 54 is formed having a hollow cylindrical shape.

Figure 3A:
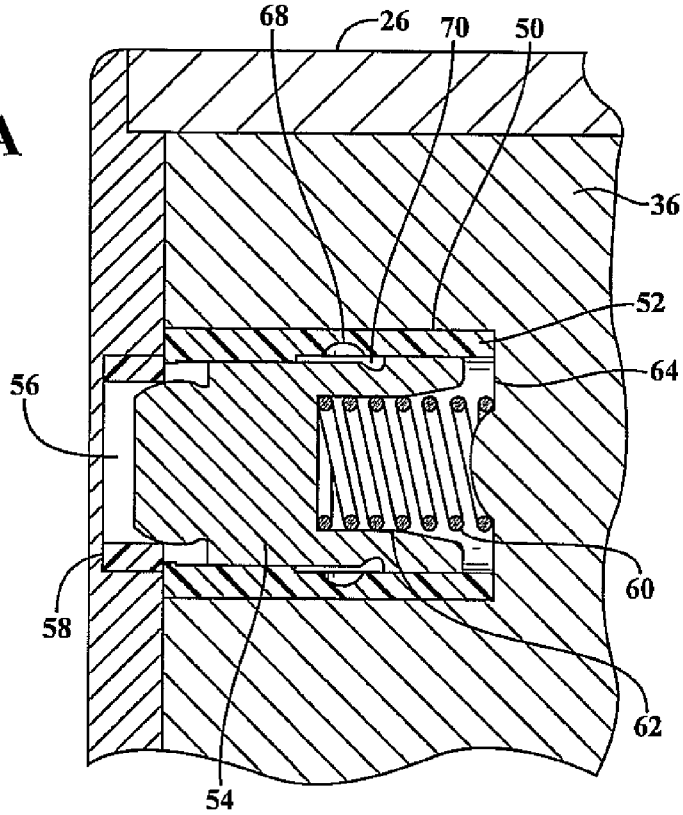
FIG. 3A is a side cross-sectional view of the variable valve timing mechanism illustrating the lock pin in the locked position.
Figure 3B:
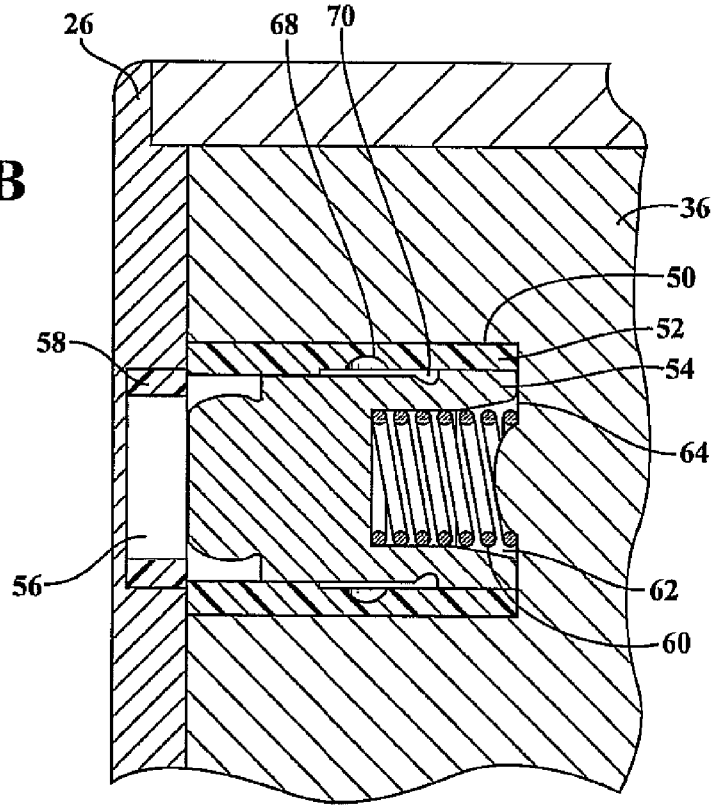
FIG. 3B is a side cross-sectional view of the variable valve timing mechanism illustrating the lock pin in the unlocked position.

With reference to FIGS. 3A and 3B, a lock bore 56 is provided in the housing 26. The lock bore 56 is provided in the fluid chamber 34 in which the vane 36, having the lock pin 54 and the pin bore 50, is provided. A wear resistant sleeve 58 is optionally provided within the lock bore 56.

The lock pin 54 is slidably received within the pin bore 50 between an unlocked position, as seen in FIG. 3B, and a locked position, as seen in FIG. 3A. In the unlocked position the lock pin 54 is disengaged from the lock bore 56 and relative rotation of the rotor 28 within the housing 26 is permitted. However, in the locked position a portion of the lock pin 54, described in greater detail below, is engaged within the lock bore 56 of the housing to prohibit rotation of the rotor 28 within the housing 26.

The pin bore 50, the lock pin 54, and the lock bore 56 are provided in the vane 36 and the fluid chamber 34, respectively, in a position which is suitable for engine startup. FIG. 2A illustrates the rotor 28 locked in a fully advanced position in anticipation of the engine's next startup procedure. It is appreciated, of course, that the position of the pin bore 50, the lock pin 54, and the lock bore 56 are variable depending upon the function required of the locking procedure0.

Returning to FIGS. 3A and 3B, a biasing member 60, such as a compression spring has one end on a bottom surface 64 of the pin bore 50 and the other end received within a cavity 62 of the lock pin 54. The biasing member 60 biases the lock pin 54 towards the locked position. During operation of the variable valve timing mechanism 10, oil from the oil pump is fed through the control valve to the arcuate retarded channel 46 which is then fed to the retarded chambers 40 via the ports 48. A pathway 66, as best seen in FIG. 2A, extends from the pin bore 50 to the edge of the vane 36. The pathway 66 allows oil to flow from the retarded chamber 40 into the pin bore 50. A guide 68 is in communication with the pathway 66 allowing the pressurized oil from the retarded chamber 40 to extend into a pin chamber 70 defined as the space between the lock pin 54 and the pin bore 50.

Figure 4A:
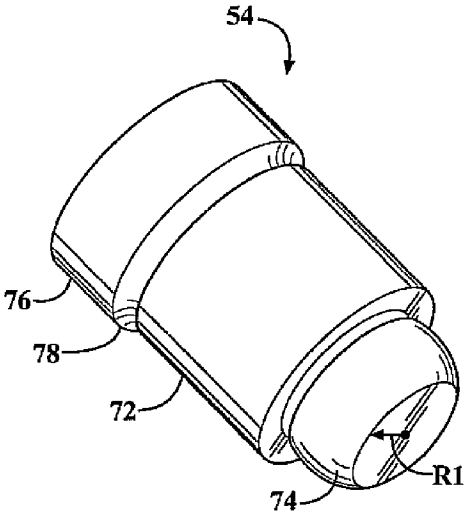
FIG. 4A is a perspective view of the inventive lock pin.
Figure 4B:
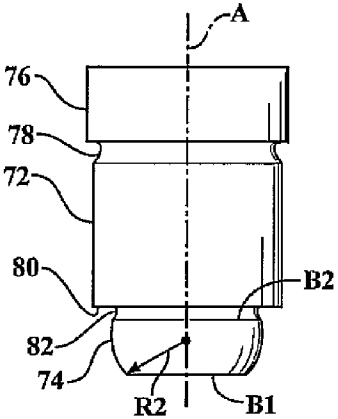
FIG. 4B is a side view of the inventive lock pin.

With reference to FIGS. 4A and 4B, the lock pin 54 is provided with a shank section 72 and an insertion section 74. The shank section 72 includes a flange 76 interconnected by a groove 78. The lock pin 54 is optionally formed as a one piece monolithic structure. The groove 78 allows for oil within the pin chamber 70 to be pressurized in order to overcome the biasing force of the biasing member 60 described in greater detail below.

The insertion section 74 has an outer side profile curved in a direction R1 that is coaxial with an axis A of the lock pin 54. Further, the outer side profile of the insertion section 74 is also curved in a direction R2 that is generally normal to the axis A, thereby providing the insertion section 74 with a generally spherical shape. The spherical segment shape provides the insertion section 74 with a nonlinear outer side profile thereby allowing the easy engagement and disengagement of the lock pin 54 with the lock bore 56.

Figure 4C:
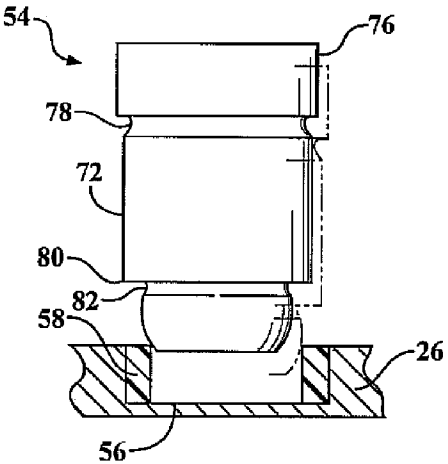
FIG. 4C illustrates the engagement of the lock pin into the lock bore.
Figure 4D:
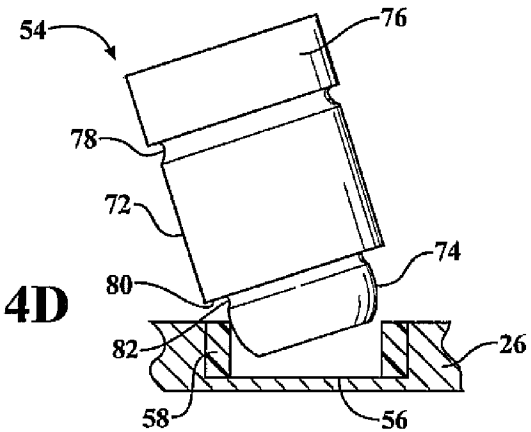
FIG. 4D illustrates the disengagement of the lock pin from the lock bore.
Figure 5C:
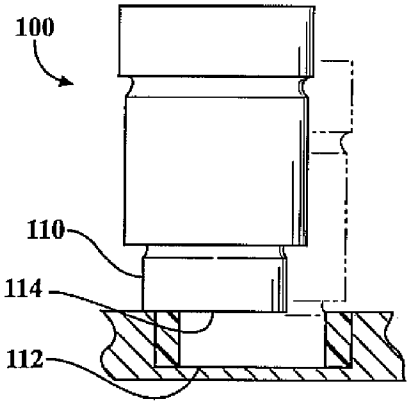
FIG. 5C Prior Art
FIG. 5C is a partial schematic view illustrating the difficulties of the engagement of the previously known lock pin into the lock bore.
Figure 6C:
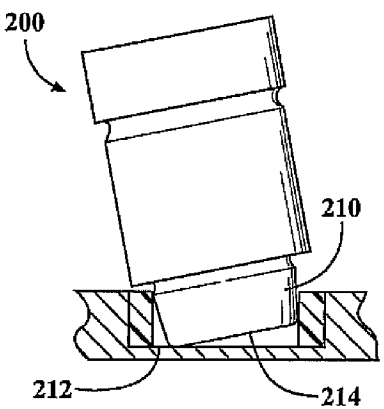
FIG. 6C Prior Art
FIG. 6C is a partial schematic view illustrating the difficulties of the disengagement of the second previously known lock pin from the lock bore.
Figure 5B:
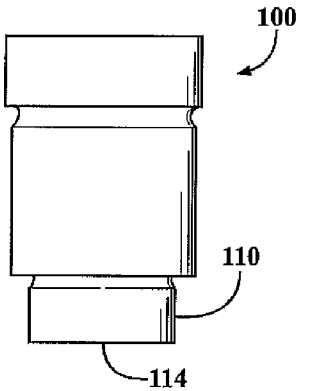
FIG. 5B Prior Art
FIG. 5B is a side view of the previously known lock pin.
Figure 6B:
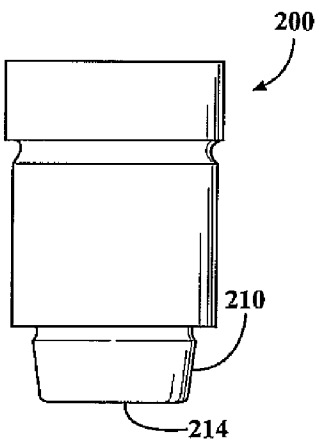
FIG. 6B Prior Art
FIG. 6B is a side view of the second previously known lock pin.
Figure 5A:
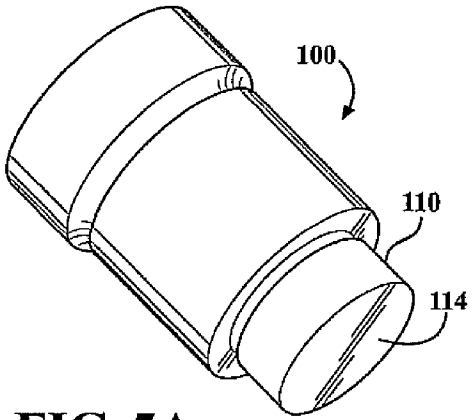
FIG. 5A Prior Art
FIG. 5A is a perspective view of a previously known lock pin.
Figure 6A:
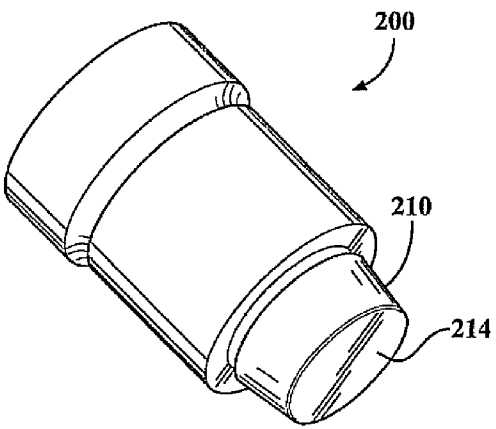
FIG. 6A Prior Art
FIG. 6A is a perspective view of a second previously known lock pin.

The spherical shape of the insertion section 74 is segmented by a first base B1, at a distal end of the insertion section 74, and a second base B2, proximate end. The first base B1 and the second base B2 are spaced apart and parallel. The first base B1 and the second base B2 are circles having centers on the axis and extending coaxially with the longitudinal axis A. Specifically, the first base B1 of the spherical segment shape of the insertion section 74 has a diameter which is less than the diameter of the lock bore 56. As best seen in FIG. 4C, the smaller diameter of first base B1 allows for a greater tolerance in alignment between the lock pin 54 and the lock bore 56 during engagement of lock pin 54 into the lock bore 56.

In the event of a misalignment between the insertion section 74 and the lock bore 56, the curved outer profile of the insertion section 74 guides the insertion portion 74 of the lock pin 54 into engagement with the lock bore 56. Further, during disengagement of the insertion section 74 from the lock bore 56 in the event of early rotation or misalignment of the vane 36 within the fluid chamber 34 having the lock bore 56 which results in the tilting of the lock pin 54, as seen in F*igure* 4D, the curved outer profile of the insertion section 74 will avoid jamming thereby reducing the noise and vibration. Specifically, as the nonlinear outer side profile of the segmented spherical shape curves towards the axis A, the first base B1 avoids contact with the edge of the lock bore 56.

The insertion section 74 is provided with a shoulder 80 connecting the second base B2 to the shank portion 72 such that the shank portion 72 has a diameter which is greater than the diameter of the first base B1 and the second base B2 of the insertion portion 74. In addition, the insertion portion 74 is provided so as to have a diameter between the first base B1 and the second base B2 which is larger than the diameter of the first base B1 and the second base B2. The nonlinear outer side profile allows the insertion section 74 to have a point to line contact between the insertion section 74 and the interior of the lock bore 56. As only a point on the curve of the insertion portion 74 contacts the inner surface of the lock bore 56 the amount of friction between the insertion portion 74 and the lock bore 56 is reduced thereby allowing for easier disengagement of the lock pin 54 from the lock bore 56.

In order to better facilitate the understanding of the variable valve timing mechanism 10, the operation will now be discussed. As the oil enters the pin bore 50, via the pathway 66 and the groove 68, the oil pressurizes the pin chamber 70, defined as the open area between the lock pin 54 and the sleeve 52, and forces the lock pin 54 against the biasing force of the biasing member 60 towards the unlocked positioned as seen in FIG. 3B. When the oil pressure in the pin chamber 70 exceeds the spring force generated by the biasing member 60, the oil pressure will overcome the biasing member 60 and move the lock pin 54 from locked position to the unlocked position. The disengagement of the lock pin 54 from the lock bore 56 thereby permits relative rotation of the rotor 26 and the housing 28.

During engine shutdown, the pressure provided by the oil pump is decreased thereby decreasing the oil pressure in the advanced chamber 38 and the retarded chamber 40. Accordingly, the oil pressure in the pin chamber 70 is reduced allowing the biasing force of the biasing member 60 to overcome the oil pressure in the pin chamber 70 such that the lock pin 54 is moved from the unlocked position to the locked position. Upon engagement of the lock pin 54 within the lock bore 56, the rotor 28 is in the locked position, thereby, preventing the rotation of the rotor 28 within the housing 26.

Similarly, during engine startup the oil pressure built up by the oil pump will be increased in the fluid chambers 34, specifically the advanced chambers 38 and the retarded chambers 40. As the oil pressure in the pin chamber 70 is increased in order to overcome the biasing force of the biasing member 60 thereby allowing the lock pin 54 to move from the locked position, as seen in FIG. 3A, towards the unlocked position as seen in FIG. 3B. In the unlocked position, the locking pin 54 no longer prohibits the relative rotation of the rotor 28 with the housing 26 thereby allowing the variable valve timing mechanism 10 to vary the opening/closing timing of the intake valves 22.

From the foregoing, it can be seen that the present invention provides a variable valve timing mechanism lock pin having a curved nonlinear outer profile which provides easy engagement and disengagement from a locked and unlocked position. Having described the invention, however, many modifications thereto will become apparent to those skilled in the art to which it pertains without deviation from the spirit of the invention as defined by the scope of the appended claims.

It is claimed:

1. A variable valve timing mechanism comprising:

a housing having a plurality of fluid chambers, one of said plurality of fluid chambers having a lock bore;

a rotor rotatably supported within said housing, said rotor having a plurality of radially extending vanes, each of said plurality of vanes extending into one of said plurality of fluid chambers to define an advanced fluid chamber and a retarded fluid chamber, said rotor including a pin bore in one of said plurality of vanes; and a lock pin having a shank section and an insertion section, said lock pin being slidably received within said pin bore between an unlocked position and a locked position, said insertion section having a segmented spherical shape having a first base and an opposite second base, said first base and said second base being spaced apart and parallel, said segmented spherical shape having a portion between said first base and said second base having a diameter greater than a diameter of said first base and said second base.

2. The variable valve timing mechanism of claim 1, wherein in said locked position at least a portion of said insertion section is received within said lock bore of said housing to prohibit relative rotation between said housing and said rotor.

3. The variable valve timing mechanism of claim 2, wherein said first base is received within said lock bore when said lock pin is in said locked position.

4. The variable valve timing mechanism of claim 3, wherein a shoulder extends between said shank section and said second base of said insertion section.

5. The variable valve timing mechanism of claim 4, wherein said first base has a diameter less than a diameter of said lock bore of said housing.

6. The variable valve timing mechanism of claim 5, wherein said second base has a diameter less than a diameter of said shank portion.

7. A variable valve timing mechanism comprising:

a housing having a plurality of fluid chambers, one of said plurality of fluid chambers having a lock bore;

a rotor rotatably supported within said housing, said rotor having a plurality of radially extending vanes, each of said plurality of vanes extending into one of said plurality of fluid chambers to define an advanced fluid chamber and a retarded fluid chamber, said rotor including a pin bore in one of said plurality of vanes; and a lock pin having a shank section and an insertion section, said lock pin being slidably received within said pin bore between an unlocked position and a locked position, said insertion section having an outer side profile curved in a direction coaxial with an axis of said lock pin and curved in a direction generally normal to said axis of said lock pin to define a segmented spherical shape having a first base and an opposite second base, said first base and said second base being spaced apart and parallel, said segmented spherical shape having a portion between said first base and said second base having a diameter greater than a diameter of said first base and said second base.

8. The variable valve timing mechanism of claim 7, wherein in said locked position at least a portion of said insertion section is received within said lock bore of said housing to prohibit relative rotation between said housing and said rotor.

9. The variable valve timing mechanism of claim 8, wherein said first base is received within said lock bore when said lock pin is in said locked position.

10. The variable valve timing mechanism of claim 9, wherein a shoulder extends between said shank section and said second base of said insertion section.

11. The variable valve timing mechanism of claim 10, wherein said first base has a diameter less than a diameter of said lock bore of said housing.

12. The variable valve timing mechanism of claim 11, wherein said second base has a diameter less than a diameter of said shank portion.

* * * * *